United States Patent [19]

Moyer

[11] 4,011,663

[45] Mar. 15, 1977

[54] APPARATUS FOR DRYING FABRICS

[75] Inventor: Richard E. Moyer, Fairport, N.Y.

[73] Assignee: Synchro Systems, Inc., St. Johnsville, N.Y.

[22] Filed: Aug. 6, 1975

[21] Appl. No.: 602,209

[52] U.S. Cl. ..... 34/155; 34/158; 34/212; 34/219

[51] Int. Cl.[2] ..... F26B 13/02

[58] Field of Search .... 34/158, 210, 212, 216–219, 34/242, 15, 155, 162; 98/36; 68/5 D, 5 E

[56] References Cited

UNITED STATES PATENTS

| | | | |
|---|---|---|---|
| 1,779,611 | 10/1930 | Merrill | 34/156 |
| 1,808,701 | 6/1931 | Wigglesworth | 68/5 |
| 3,659,551 | 5/1972 | McKinstry | 98/36 |
| 3,766,662 | 10/1973 | Moyer | 34/158 |

FOREIGN PATENTS OR APPLICATIONS

| | | | |
|---|---|---|---|
| 1,002,297 | 8/1965 | United Kingdom | 98/36 |

*Primary Examiner*—John J. Camby
*Assistant Examiner*—Larry I. Schwartz
*Attorney, Agent, or Firm*—Shlesinger, Fitzsimmons & Shlesinger

[57] ABSTRACT

In a machine which uses superheated steam for drying wet fabrics vertical curtains of hot air are blown across the entrance and exit openings to prevent escape of steam and to help dry the fabric. A portion of the superheated steam is piped from the drying chamber to a preheat chamber, which is located in advance of the drying chamber, thereby to preheat the fabric before it enters the drying chamber. The moisture driven from the fabrics is collected as wet steam from the top of the drying chamber and fed to a condenser the cooling water of which is thereby heated and saved for heating purposes.

10 Claims, 4 Drawing Figures

APPARATUS FOR DRYING FABRICS

This invention relates to apparatus for drying fabrics, and more particularly to apparatus for drying wet dyed fabrics and for setting the colors in printed fabrics. Even more particularly, this invention relates to an improvement over the apparatus disclosed in my U.S. Pat. No. 3,766,662.

As pointed out in my above-noted U.S. patent, the ordinary method of drying fabrics by passing a current of heated air over the fabric is very inefficient. For example, the temperature of the air must be carefully controlled to prevent damage to the fabric being dried; the drying chamber must be extremely long; and the heated air is exhausted from the chamber after it has been used to dry the fabric, thereby wasting a great deal of the heat still contained in the air.

These disadvantages led to the use of superheated steam to dry dyed fabrics. The material that is to be dried is mounted upon a tenter frame and is passed through a sealed chamber which is filled with superheated steam. The steam is forced through the fabric by circulating fans and drys the fabric much more rapidly than heated air. Moreover, the necessary drying chamber is much smaller than that required when heated air is employed.

In apparatus of the type which employs superheated steam, it is customary to recirculate part of the superheated steam from the drying chamber to the heating chamber, after the steam has passed through the fabric. Consequently at least part of the superheated steam is recycled continuously. It is customary also to draw off from the drying chamber the moisture, which is driven from the fabric in the form of wet steam by the superheated steam, and to condense the moisture which is drawn off. To increase the efficiency of the apparatus it has been customary also to preheat the fabric before it enters the chamber containing the superheated drying steam, for example by feeding into the preheat chamber some of the recycled superheated steam.

One of the problems heretofore encountered with apparatus of the type described has been the difficulty in sealing openings to prevent escape of steam and moisture from the entrance and exits for the preheat and superheat chambers, respectively. It has also been found that the feeding of recycled superheated steam to the preheat chamber has at times discharged objectionable oil and foreign particles into the fabric as it is introduced into the preheat chamber. Still another disadvantage is that prior such apparatus did not make very efficient use of the hot steam or moisture withdrawn from the drying chamber.

It is an object of this invention to provide improved fabric drying apparatus which uses superheated steam more efficiently than prior such apparatus.

Another object of this invention is to provide improved drying apparatus of the type described which obviates the possibility of spotting the moist fabric as it enters and passes through the preheat chamber.

Still another object of this invention is to provide improved means for sealing the fabric entrance and exits for apparatus of the type described.

Other objects of the invention will be apparent hereinafter from the specification and from the recital of the appended claims, particularly when read in conjunction with the accompanying drawings.

Figure 1:
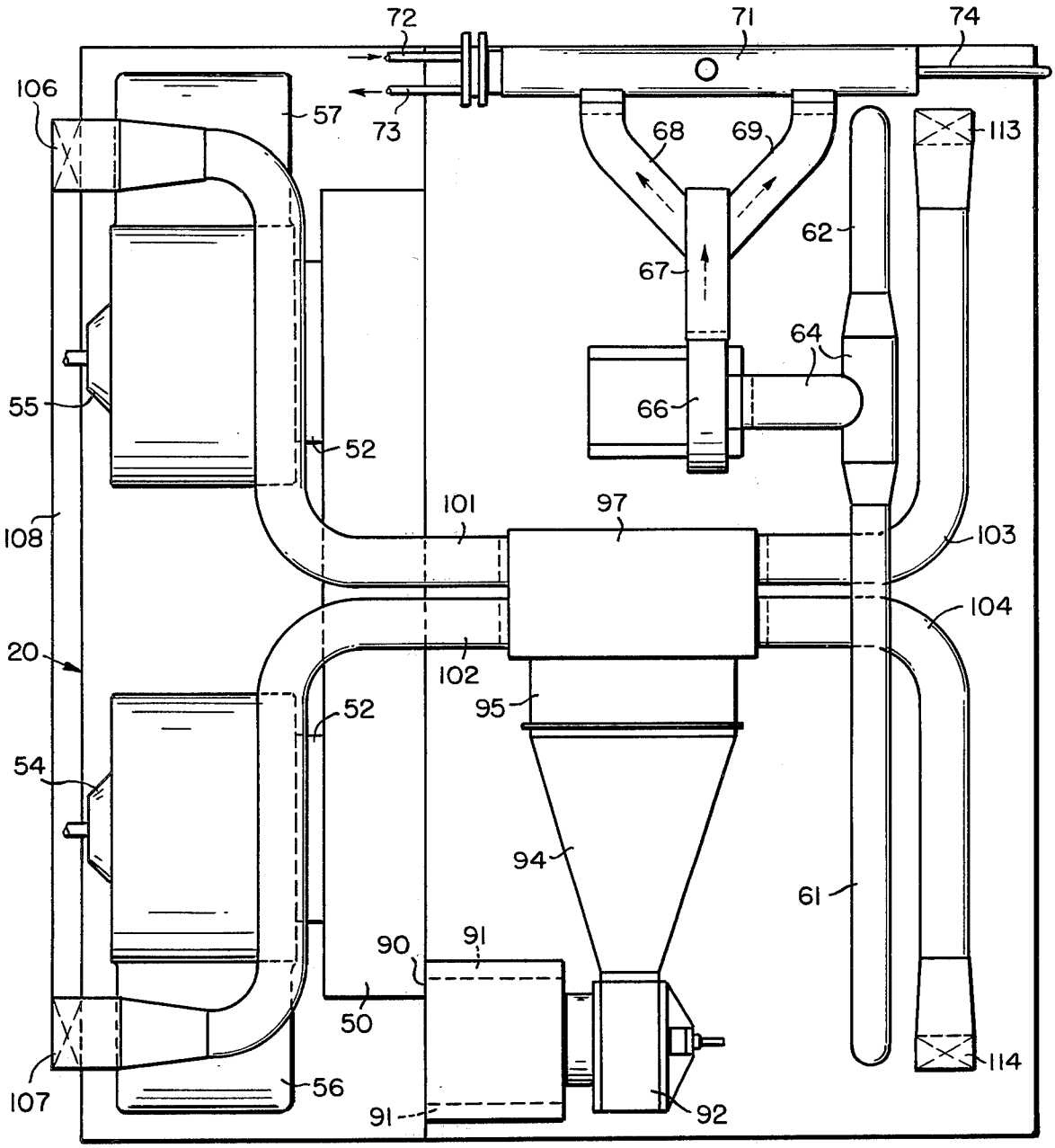
FIG. 1 is a fragmentary plan view of drying apparatus made according to one embodiment of this invention.

Referring now to the drawings by numerals of reference, 20 denotes generally the hollow frame of a machine, which is similar in many respects to the machine illustrated in my above-noted U.S. Pat. No. 3,766,662. The base section of the machine includes a collecting chamber 22, which extends substantially across the whole width of the machine, and which has two side-by-side openings in its forward end which communicate with a pair of side-by-side heating chambers, one of which is denoted at 26 in FIG. 2. Each of the heating chambers has mounted therein a plurality of tubular heating coils, such as denoted at 29, which are employed to heat to the desired drying temperature the superheated steam which is used in the apparatus. Preferably these coils are of special design so that they may be used with a liquid phase heating system (hot oil). The oil used has practically no pressure at 600° F. Therefore the coils 29 are only subjected to the pump pressure required to maintain the oil circulation. This contrasts with the use of steam coils, which would require steam pressure in excess of 1500 p.s.i. in order to obtain temperatures of 600° F.

Figure 2:
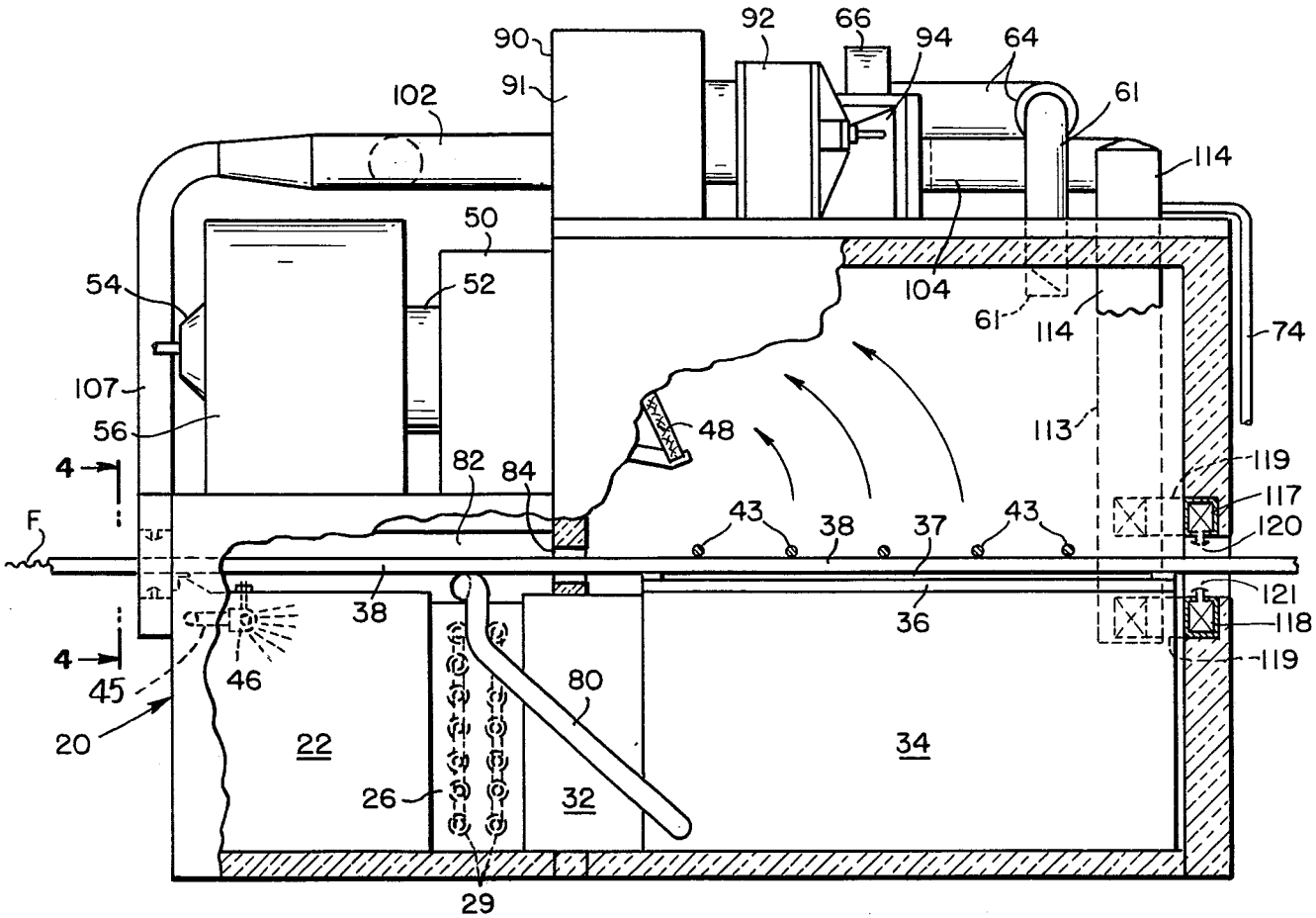
FIG. 2 is a fragmentary side elevational view of this apparatus, portions of the apparatus being cut away and shown in section for purposes of illustrations.

The side-by-side heating chambers are connected by transition ducts, one of which is denoted at 32 in FIG. 2, with a large distribution or drying chamber 34, which also extends for substantially the full width of the machine. Extending transversely across chamber 34, approximately medially of its upper and lower ends are two, perforated, diffusion plates 36 and 37, which are placed horizontally one on top of the other. These plates are located just beneath a pair of spaced, parallel, tenter frame rails 38, which extend longitudinally through the machine, and which form part of a conventional tenter frame conveyor of the type disclosed in greater detail in my U.S. Pat. No. 3,766,662. The fabric F (FIG. 2), which is to be dryed, is attached to the tenter frame conveyor in known manner, and enters the machine through a slot 40 at one end of the machine (the left end in FIG. 2), and leaves the machine through the slot 41 located in the outer wall chamber 34. As it travels through the steam chamber 34 the fabric passes beneath a plurality of restraining rollers 43 which prevent billowing of the fabric as it moves through chamber 34.

Steam is supplied to the machine from any suitable source through a pipe 45 (FIG. 2) and a manifold 46 to the collecting chamber 22. From here the steam is drawn forwardly through the two heating chambers, including chamber 26, where it is superheated, and then passes through the transition ducts, including duct 32, into the diffusion or drying chamber 34 beneath the diffusion plates 36 and 37. From here the steam rises upwardly through the last-named plates and any fabric positioned thereon, and enters the upper half of chamber 34. Most of the steam that passes through the fabric is then recirculated from the upper end of the chamber 34 through a plurality of filters 48 to a plenum 50, which extends across the back of chamber 34 adjacent its upper end. From the plenum 50 the recirculated steam passes through a pair of spaced ducts 52 (FIGS. 1 and 2) to the suction sides of two large circulating fans 54 and 55, the discharge sides of which are connected through ducts 56 and 57, respectively, to opposite ends of the collecting chamber 22.

Most of the apparatus thus far described is similar to that disclosed in my above-noted Pat. No. 3,766,662. When the fabric to be dried has been placed in the superheat chamber 34, the recirculating fans 54 and 55 drive steam through the heating chambers and transition ducts to the lower half of chamber 34, where the pressure forces the superheated steam upwardly through the interstices of the fabric F to drive moisture therefrom into the upper half of chamber 34. As noted above most of the superheated steam passing through the fabric is recirculated by the fans 54 and 55, However, most of the moisture driven from the fabric is present as wet steam in the upper half of the chamber 34 and must be drawn off.

To remove moisture from the upper half of chamber 34 the improved apparatus includes a pair of exhaust ducts 61 and 62 (FIGS. 1 to 3), which extend downwardly into the upper end of chamber 34 adjacent opposite sides of the machine, and which are connected at their opposite ends by a T-shaped duct 64 to the input or suction side of an exhaust fan 66, which is mounted on top of the frame of the machine adjacent one side thereof. The discharge side of fan 66 is connected by a conduit 67 (FIG. 1) to a pair of ducts 68 and 69, which discharge into the jacket of an elongate condenser 71, which is mounted on top of the machine at said one side thereof. Cooling water is circulated through the condenser 71 by an input pipe 72, which is connected to a supply of cool water, and by a discharge pipe 73, which conveys the cooling water out of the condenser after it has been heated or warmed by the steam circulating in the jacket of the condenser. The warm water discharged through pipe 73 can be saved and utilized for heating purposes. The condensate produced in the jacket of the condenser 71 by the condensed exhaust steam is discharged through a pipe 74, which projects from the end of the condenser opposite the pipes 72 and 73. The heat contained in this condensate also can be utilized for heating purposes in a manner similar to the warm water discharged through the pipe 73.

Figure 3:
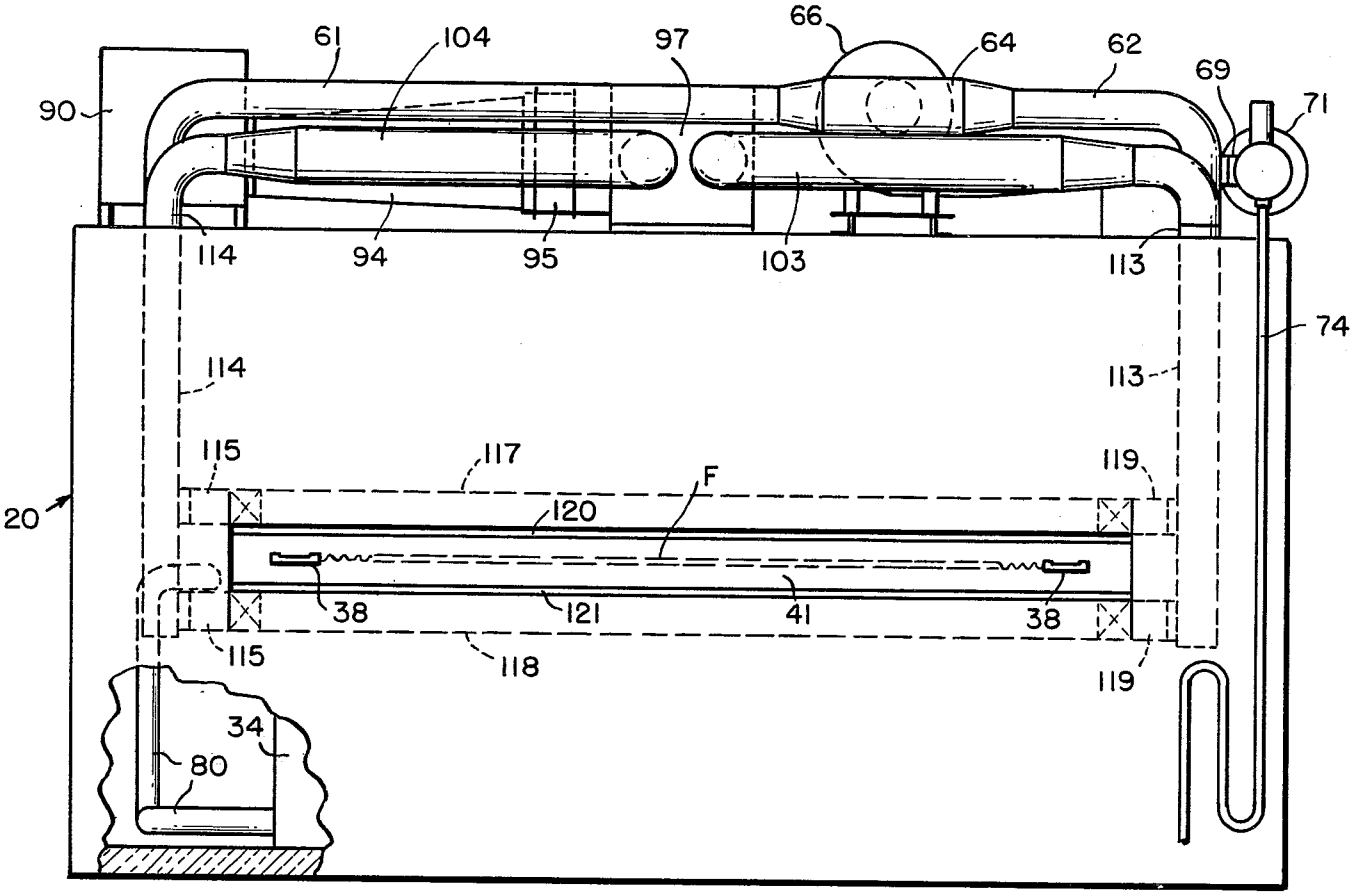
FIG. 3 is a fragmentary end elevational view of this apparatus looking toward the right side of the apparatus as shown in FIG. 1.

Another improvement embodied in this apparatus involves the use of two bypass, ducts 80 adjacent opposite sides of the machine to convey part of the superheated steam from the lower half of chamber 34 to a preheat chamber 82 to preheat the fabric before it enters chamber 34. For this purpose each of the two ducts 80, one of which is shown in FIGS. 2 and 3, is connected at its lower end to chamber 34 adjacent the discharge end of the associated transition duct 32, and is connected at its opposite, upper end to the inlet or preheat chamber 82, which is formed in the machine above the collecting and heating chambers, and between the inlet 40 and a passage 84 formed in the machine between the preheat and superheat chambers 82 and 34, respectively. The pressure in the lower half of the distribution chamber 34 is higher than the pressure in the preheat chamber 82, so that part of the superheated steam delivered to chamber 34 is conveyed through the preheat ducts 80 into chamber 82 to preheat the fabric F before it enters through the passage 84 into chamber 34.

With steam circulating in both the preheat chamber 82 and the diffusion chamber 84, it is essential to provide some form of seal for the inlet and outlet openings 40 and 41 to supress the discharge of steam from these openings. For this purpose a large fresh air inlet housing 90 is mounted on the top of the machine adjacent the side thereof remote from the condenser 71. Inlet openings in opposite sides of housing 90 are covered by porous filters 91, which allow fresh air to be drawn through the housing to the inlet or suction side of a large blower 92, which is mounted on the machine adjacent housing 90. The discharge of blower 92 is connected by a transition duct 94 to a heating chamber 95 containing a row of heater coils (not illustrated) for heating air that is blown into the chamber by the fan 92. The heating chamber 95 communicates opposite the transition duct 94 with a plenum 97, which is mounted on top of the machine frame substantially centrally thereof. At one end plenum 97 communicates with one end of each of two hot air supply ducts 101 and 102, which deliver air to the front side of the machine as noted hereinafter; and at its opposite end plenum 97 is connected to each of two further hot air supply ducts 103 and 104, which supply hot air to the discharge or rear of the machine as noted hereinafter.

Figure 4:
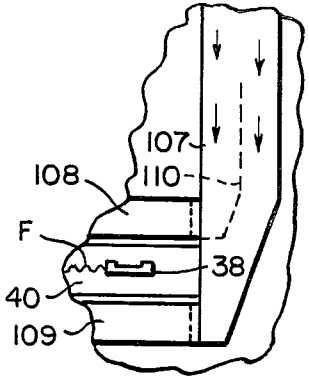
FIG. 4 is a fragmentary sectional view taken along the line 4—4 in FIG. 2 looking in the direction of the arrows.

As shown more clearly in FIGS. 1 and 2, the supply ducts 101 and 102 project in opposite directions over the tops of the circulation fans 54 and 55, and communicate with the upper ends of vertically disposed distribution ducts 106 and 107, respectively. At their lower ends ducts 106 and 107 communicate with opposite ends of a pair of vertically spaced conduits 108 and 109 (FIGS. 1 and 4), which extend along the front of the machine at the upper and lower sides, respectively, of the entrance 40. A baffle 110 located in the lower end of each duct 107 and 108 divides the respective duct in half, and directs part of the air from the supply ducts 101 and 102 respectively, into opposite ends of the conduits 108 and 109, respectively. Medially of their lower and upper walls, respectively, conduits 108 and 109 have therein longitudinally extending slots which communicate with elongate nozzles 110 and 111, which project, respectively, from the underside of conduit 108 and from the upper side of conduit 109. These nozzles direct vertical curtains of hot air across the entrance 40, and against opposite sides of the fabric F as it enters the machine.

The hot air supply ducts 103 and 104 extend over opposite sides of the machine adjacent its rear end, and communicate with the upper ends of vertical ducts 113 and 114, which extend downwardly through the top of the machine and into chamber 34 adjacent opposite sides thereof. Adjacent its lower end the duct 114 is connected by a pair of smaller, vertically spaced ducts 115 with the adjacent ends of two, vertically spaced, horizontally disposed conduits 117 and 118, which extend along the rear of the machine adjacent the upper and lower edges of the exit opening 41, and just inside of the rear wall of the machine frame. In a like manner, the duct 113 is connected adjacent its lower end to the opposite ends of the conduits 117 and 118 by a pair of vertically spaced ducts 119. As in the case of the ducts 108 and 109, the ducts 117 to 118 have therein medially of their upper and lower surfaces, respectively, longitudinally extending slots which register with elongate nozzles 120 and 121, which project, respectively, from the underside of conduit 117 and from the upper side of conduit 118. As in the case of the nozzles 110 and 111, the nozzles 120 and 121 direct vertical curtains of hot air against opposite sides of the fabric F rearwardly of the exit 41. These curtains of hot air, which cover the entrance and exit openings, thus help to retain steam within the chambers 82 and 34, and assist also in drying the fabric.

From the foregoing, it will be apparent that the instant invention provides substantially more efficient and reliable drying apparatus than was heretofore available. By using the hot curtains of air across the entrance and exit of the machine, substantially litle or no steam escapes from the machine into the surrounding room, thus minimizing the discomfort of persons in the room. This feature also reduces unnecessary loss of steam from the chambers 82 and 34 and also assists in drying the fabric. Moreover, since the hot air generated in the heater 95 is essentially dry, it will not spot or otherwise damage the fabric which it contacts.

The use of superheated steam for preheating the fabric also has the advantage that it is not necessary to pump the preheat steam from one area of the machine to another. On the contrary, the pressure that is developed in the lower half of chamber 34 is sufficient to cause some of the superheated steam entering the chamber to travel through the ducts 80 into the preheat chamber, so that the steam introduced into this chamber will be clean and free from undesirable oil vapors, or the like. Still another advantage of this apparatus is that, by employing the condenser 71 to recover the condensate in the moist steam which rises in the upper half of the chamber 34, the heat in this exhaust steam can be utilized to heat the cooling water used in the condenser, thus providing in the outlet pipe 73 heated water which can in turn be used for heating purposes, as desired. Also, as previously noted, the condensate dischared through the pipe 74 can likewise be used for heating purposes, or if desired, can be discharged to a sump.

While only a single embodiment of this invention has been illustrated and described in detail herein, it will be apparent that it is capable of further modification, and that this application is intended to cover any such modifications which may fall within the scope of one skilled in the art or the appended claims.

Having thus described my invention, what I claim is:

1. Apparatus for drying wet fabrics, comprising a machine frame having therein a preheat chamber communicating with an entrance to said frame, and a diffusion chamber, communicating with an exit from said frame, means for advancing a strip of wet fabric in a plane successively through said entrance, and preheat chamber, said diffusion chamber and said exit, means for circulating superheated steam from a supply thereof through said diffusion chamer from an inlet adjacent one side of said diffusion chamber to an outlet adjacent the opposie side thereof, and transversely of the fabric in said diffusion chamber, whereby the steam is caused to pass through the last-named fabric from one side hereof to the other, thereby to drive moisture therefrom, said circulating means including means for recirculating said steam back to said supply the steam has passed through said fabric, and duct means opening on said diffusion chamber at said one side of the fabric and directly connecting said diffusion chamber to said preheat chamber to feed part of the steam which enters said diffusion chamber to said preheat chamber before the last-named steam has passed through any fabric in said diffusion chamber.

2. Apparatus as defined in claim 1, wherein said duct means comprises a plurality of ducts each of which is connected at one end to said diffusion chamber adjacent said inlet and at its opposite end to said preheat chamber, and wherein the pressure of the steam in said diffusion chamber is operative to force said part thereof into said preheat chamber.

3. Apparatus as defined in claim 1, including means for generating a supply of hot air under pressure, and means connected to said supply of hot air for directing said air in the form of hot air curtains transversely across said entrance and said exit, respectively.

4. Apparatus as defined in claim 1, including exhaust means connected to said diffusion chamber adjacent said outlet for withdrawing the wet portion of said steam from the diffusion chamber, after the steam has passed through the fabric therein, and a condenser connected to said exhaust means to receive and condense the volt steam drawn from said diffusion chamber.

5. Apparatus as defined in claim 3, wherein said means for directing said hot air, comprises a pair of spaced conduits positioned along opposite sides of each of said entrance and exit, respectively, and at opposite sides of the plane of travel of said fabric, a first pair of supply ducts connecting said hot air supply to opposite ends, respectively of the pair of conduits flanking said entrance, and a second pair of supply ducts connecting said hot air supply to opposite ends, respectively, of the pair of conduits flanking said exit, and each pair of conduits having on the confronting surfaces thereof elongate nozzles which communicate with the interior of the associated conduit to deliver hot air therefrom in the form of transverse curtains across said entrance and exit, respectively.

6. Apparatus as defined in claim 5 including baffle means mounted in each of said first pair of ducts adjacent one end thereof to direct part of the hot air received from said supply into the adjacent end of one of the conduits flanking said entrance, and to direct the remaining portion of said hot air into the adjacent end of the other of the last-named conduits.

7. Apparatus for drying wet fabrics, comprising a machine frame having therein a preheat chamber communicating with an entrance to said frame, and a diffusion chamber, communicating with an exit from said frame, means for advancing a strip of wet fabric in a plane successively through said entrance, said preheat chamber, said diffusion chamber and said exit, means for circulating superheated steam from a supply thereof through said diffusion chamber from an inlet adjacent one side said diffusion chamber to an outlet adjacent the opposite side thereof, and transversely of the fabric in said diffusion chamber, whereby the steam is caused to pass through the last-named fabric to drive moisture therefrom, means for feeding at least a portion of said steam from said diffusion chamber to said preheat chamber, and means for blowing curtains of hot air transversely across said entrance and said exit to help prevent the discharge of steam therethrough from said preheat chamber and said diffusion chamber, respectively.

8. Apparatus as defined in claim 7, wherein the last-named means is operable independently of said steam circulating means, and includes means for supplying substantially moisture-free hot air for said curtains.

9. Apparatus as defined in claim 8 wherein said feeding means comprises a plurality ducts extending between said preheat chamber and said diffusion chamber and operative to convey part of said superheated steam from said diffusion chamber directly to said preheat chamber, and before the last-named portion of said steam has passed through the fabric in said diffusion chamber.

10. Apparatus as defined in claim 9, including a condenser mounted on said machine frame and connected to a cooling water supply which is operative to circulate cooling water through said condenser, and an exhaust fan on said frame having its suction side connected to said diffusion chamber adjacent said outlet, and having its discharge side connected to said condenser to convey thereto wet steam drawn from said diffusion chamber, whereby the cooling water in said condenser is heated by the moist steam withdrawn from said diffusion chamber, and may be used for heating purposes.

* * * * *